US009695736B2

(12) United States Patent
Sugimoto et al.

(10) Patent No.: US 9,695,736 B2
(45) Date of Patent: Jul. 4, 2017

(54) COOLING DEVICE FOR INTERNAL COMBUSTION ENGINE AND FAILURE DIAGNOSIS METHOD FOR COOLING DEVICE FOR INTERNAL COMBUSTION ENGINE

(71) Applicant: Toyota Jidosha Kabushiki Kaisha, Toyota-shi, Aichi-ken (JP)

(72) Inventors: Hitoki Sugimoto, Toyota (JP); Toshitake Sasaki, Toyota (JP); Yoshihisa Oda, Toyota (JP); Kenji Kimura, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 255 days.

(21) Appl. No.: 14/512,749

(22) Filed: Oct. 13, 2014

(65) Prior Publication Data

US 2015/0107345 A1 Apr. 23, 2015

(30) Foreign Application Priority Data

Oct. 17, 2013 (JP) ..... 2013-216237
Sep. 17, 2014 (JP) ..... 2014-188364

(51) Int. Cl.
*G01M 15/00* (2006.01)
*F01P 11/16* (2006.01)
*F01P 11/18* (2006.01)

(52) U.S. Cl.
CPC ..... *F01P 11/16* (2013.01); *F01P 11/18* (2013.01); *F01P 2023/08* (2013.01); *F01P 2025/32* (2013.01); *F01P 2031/00* (2013.01)

(58) Field of Classification Search
USPC ..... 73/114.68
See application file for complete search history.

(56) References Cited

U.S. PATENT DOCUMENTS 4,556,029 A * 12/1985 Yamaguchi ..... F01P 11/16 123/179.15
6,283,381 B1 * 9/2001 Uchiyama ..... F01P 11/16 123/41.15

(Continued)

FOREIGN PATENT DOCUMENTS

JP H10-176534 A 6/1998
JP 2004-353592 A 12/2004

(Continued)

*Primary Examiner* — Eric S McCall
*Assistant Examiner* — Mohammed E Keramet-Amircola
(74) *Attorney, Agent, or Firm* — Dinsmore & Shohl LLP

(57) ABSTRACT

An ECU sets a leakage flow rate flowing through a radiator circulation passage in a closed state of a thermostat valve, calculates an estimated temperature of coolant water in the radiator circulation passage based on a set leakage flow rate and a detected water temperature of an engine-side coolant water temperature sensor, and performs a failure diagnosis for the thermostat valve based on a difference between the calculated estimated temperature and the detected water temperature of the radiator-side coolant water temperature sensor. The leakage flow rate during operation of the electric pump is set to be a larger value as compared to the leakage flow rate during stopping of the pump. As a result, a diagnostic can be prevented by improving an accuracy of failure detection for the thermostat valve.

8 Claims, 4 Drawing Sheets

(56) References Cited

U.S. PATENT DOCUMENTS

| | | | | |
|---|---|---|---|---|
| 6,386,022 | B1 * | 5/2002 | Oka | F01P 11/16 73/114.68 |
| 6,752,011 | B2 * | 6/2004 | Matsumoto | F01P 11/16 73/114.48 |
| 8,849,540 | B2 * | 9/2014 | Nagashima | G01M 15/042 701/99 |
| 9,341,106 | B2 * | 5/2016 | Hayase | F01P 7/165 |
| 2004/0262411 | A1 | 12/2004 | Tsukamoto et al. | |
| 2011/0120216 | A1 * | 5/2011 | Sugimoto | F01P 7/164 73/114.68 |
| 2012/0085157 | A1 | 4/2012 | Nishigaki | |
| 2015/0152775 | A1 * | 6/2015 | Ando | F01P 7/165 165/287 |

FOREIGN PATENT DOCUMENTS

| | | | |
|---|---|---|---|
| JP | 2007-056722 | A | 3/2007 |
| JP | 2012-082731 | A | 4/2012 |

* cited by examiner

COOLING DEVICE FOR INTERNAL COMBUSTION ENGINE AND FAILURE DIAGNOSIS METHOD FOR COOLING DEVICE FOR INTERNAL COMBUSTION ENGINE

This nonprovisional application is based on Japanese Patent Application No. 2013-216237 filed on Oct. 17, 2013 and No. 2014-188364 filed on Sep. 17, 2014 with the Japan Patent Office, the entire contents of which are hereby incorporated by reference.

BACKGROUND OF THE INVENTION

Field of the Invention

The present invention relates to a cooling device for an internal combustion engine, and a failure diagnosis method for a cooling device for an internal combustion engine. More particularly, it relates to a cooling device for an internal combustion engine having a failure diagnosis function for a thermostat valve and a failure diagnosis method for the cooling device of an internal combustion engine.

Description of the Background Art

Japanese Patent Laying-Open No. 2007-056722 discloses a cooling device for an internal combustion engine, in which a cooling passage connecting an engine coolant water passage provided in the engine to a radiator is disposed, and an electric pump circulating coolant water in this cooling passage is provided. This cooling device includes a failure detection system which performs a failure diagnosis for a thermostat valve adjusting a temperature of coolant water by switching cooling passages.

In this failure detection system, a coolant water temperature detected or estimated by a coolant water temperature sensor is compared with a preliminarily set reference value to perform the failure diagnosis for the thermostat valve. At this time, when a flow rate of the coolant water is increased by driving of the electric pump, a heat transfer rate from the engine to the coolant water is changed, thus a correction coefficient for correcting the reference value is set larger as the coolant water flow rate is larger.

Even when the water temperature is provided which in nature does not allow the thermostat valve to be opened, if the water pressure in the coolant water passage is raised by driving of the pump, a leakage flow rate occurs in the cooling passage. The leakage flow rate represents a flow rate of the coolant water flowing to the radiator in a closed state of the thermostat valve. In this case, even though the thermostat valve is closed, engine-side coolant water in the engine coolant water passage is mixed with radiator-side coolant water in the cooling passage connected to the radiator, so that the temperatures of coolant water on both sides come close to likely cause lowering in the accuracy of the failure diagnosis.

More in detail, in the case where the thermostat valve is connected to a radiator circulation passage, which allows coolant water discharged from the engine coolant water passage to pass through the radiator and return to the engine coolant water passage, and a bypass passage, which allows coolant water discharged from the engine coolant water passage to return to the engine coolant water passage without passing through the radiator, a temperature sensor is provided on the radiator circulation passage in addition to a temperature sensor for detecting the temperature of the engine coolant water passage, so that an open failure of the thermostat valve can be detected by referring to a difference between the two temperature sensors. Specifically, in the case where the difference between the two temperature sensors is small even when a closing instruction is given to the thermostat valve, it is determined that the open failure occurs in the thermostat valve.

However, even when the thermostat valve is in a normal state (closed state), the leakage flow rate occurs in the radiator circulation passage during operation of the pump. Occurrence of this leakage flow rate causes the difference between the two temperature sensors to be small, so that there is a possibility that the thermostat valve is misdiagnosed as being in the open failure. Therefore, while it can be considered to take into consideration the leakage flow rate into the failure diagnosis for the thermostat valve, no observation is made as to this point for the failure detection system disclosed in Japanese Patent Laying-Open No. 2007-056722.

SUMMARY OF THE INVENTION

The present invention was made to solve the problem described above, and its object is to provide a cooling device for an internal combustion engine and a failure diagnosis method for a cooling device for an internal combustion engine, capable of preventing misdiagnosis by improving the accuracy of detection of the failure in the thermostat valve.

According to the present invention, a cooling device for an internal combustion engine includes a coolant water passage formed in the internal combustion engine, a radiator configured to cool coolant water, a radiator circulation passage, a bypass passage, and a thermostat valve connected to the radiator circulation passage and the bypass passage. The radiator circulation passage is configured to allow coolant water discharged from the coolant water passage to pass through the radiator and return to the coolant water passage. The bypass passage is configured to allow coolant water discharged from the coolant water passage to return to the coolant water passage without passing through the radiator. The thermostat valve is switched in accordance with a temperature of coolant water flowing in the thermostat valve to either a closed state of interrupting coolant water from the radiator circulation passage and outputting coolant water from the bypass passage to the coolant water passage or an opened state of outputting coolant water from the radiator circulation passage and coolant water from the bypass passage to the coolant water passage. The cooling device for an internal combustion engine further includes a pump configured to circulate coolant water, a first temperature sensor configured to detect a temperature of coolant water in the coolant water passage, a second temperature sensor configured to detect a temperature of coolant water in the radiator circulation passage, and a diagnosis unit. The diagnosis unit estimates a temperature of coolant water in the radiator circulation passage in the radiator circulation passage based on a leakage flow rate, which is set as a flow rate flowing through the radiator circulation passage even when the thermostat valve is in the closed state, and an output of the first temperature sensor, and performs a failure diagnosis for the thermostat valve based on a difference between the estimated temperature and a detected temperature of second temperature sensor. Herein, the leakage flow rate during operation of the pump is set to be a larger value as compared to the leakage flow rate during stopping of the pump.

With such a configuration, even when the leakage flow rate to the radiator circulation passage occurs due to the operation of the pump, and the difference between the coolant water temperature in the coolant water passage and the coolant water temperature in the radiator circulation passage becomes smaller, the coolant water temperature in the radiator circulation passage is estimated taking into consideration the occurrence of the leakage flow rate to the radiator circulation passage due to the operation of the pump, so that the accuracy of the failure diagnosis for the thermostat valve can be improved.

Preferably, the leakage flow rate for a large flow rate of the pump or a large physical quantity related to the flow rate of the pump (hereinafter, simply referred to as "pump flow rate") is set to be a larger value as compared to the leakage flow rate for a small pump flow rate.

According to such a configuration, even when the difference between the coolant water temperature in the coolant water passage and the coolant water temperature in the radiator circulation passage becomes smaller due to an increase in the pump flow rate and in turn an increase in the leakage flow rate to the radiator circulation passage, the coolant water temperature in the radiator circulation passage is estimated taking into consideration the increase in the leakage flow rate to the radiator circulation passage due to the increase in the pump flow rate, so that the accuracy of the failure diagnosis for the thermostat valve can be improved.

Preferably, the diagnosis unit determines that the thermostat valve is failed when a ratio of time with a detected temperature of the second temperature sensor higher than the estimated temperature is higher than a predetermined value.

According to this configuration, the influence of a temporary disturbance is reduced, so that a failure detection for the thermostat valve can be performed in a more stable manner.

Preferably, the pump is an electric water pump driven by an electric motor.

According to this configuration, since the water pump may operate even when the internal combustion engine is stopped, the frequency of the failure diagnosis for the thermostat valve by the diagnosis unit can be made higher.

Preferably, the physical quantity includes at least one of a rotation speed of the electric water pump, a rotation speed of the internal combustion engine, an intake amount of the internal combustion engine, and a load of an air-conditioning heater.

According to this configuration, the leakage flow rate is corrected based on at least one of the flow rate of the electric water pump, the rotation speed of the internal combustion engine, the intake amount of the internal combustion engine, and the load of the air-conditioning heater. Thus, the leakage flow rate can be corrected accurately taking into consideration the condition of driving of the electric water pump.

Preferably, the pump is a mechanical water pump driven by the internal combustion engine. The physical quantity is a rotation speed of the internal combustion engine.

According to this configuration, since there is no need to provide a separate electric water pump, the improvement in the failure diagnosis for the thermostat valve can be achieved with a low cost.

Moreover, according to the present invention, a failure diagnosis method is a failure diagnosis method for a cooling device for an internal combustion engine. The cooling device includes a coolant water passage formed in an internal combustion engine, a radiator configured to cool coolant water, a radiator circulation passage, a bypass passage, and a thermostat valve connected to the radiator circulation passage and the bypass passage. The radiator circulation passage is configured to allow coolant water discharged from the coolant water passage to pass through the radiator and return to the coolant water passage. The bypass passage is configured to allow coolant water discharged from the coolant water passage to return to the coolant water passage without passing through the radiator. The thermostat valve is switched in accordance with a temperature of coolant water flowing in the thermostat valve to either a closed state of interrupting coolant water from the radiator circulation passage and outputting coolant water from the bypass passage to the coolant water passage or an opened state of outputting coolant water from the radiator circulation passage and coolant water from the bypass passage to the coolant water passage. The cooling device further includes a pump configured to circulate coolant water, a first temperature sensor configured to detect a temperature of coolant water in the coolant water passage, and a second temperature sensor configured to detect a temperature of coolant water in the radiator circulation passage. The failure diagnosis method includes the steps of setting a leakage flow rate flowing through the radiator circulation passage even when the thermostat valve is in the closed state, estimating a temperature of coolant water in the radiator circulation passage based on the set leakage flow rate and an output of the first temperature sensor, and performing a failure diagnosis for the thermostat valve based on a difference between the estimated temperature and a detected temperature of the second temperature sensor. Herein, in the step of setting a leakage flow rate, the leakage flow rate during operation of the pump is set to have a larger value as compared to the leakage flow rate during stopping of the pump.

With such a configuration, even when the difference between the coolant water temperature in the coolant water passage and the coolant water temperature in the radiator circulation passage becomes small due to occurrence of the leakage flow rate to the radiator circulation passage by operation of the pump, the coolant water temperature in the radiator circulation passage is estimated taking into consideration the occurrence of the leakage flow rate to the radiator circulation passage by operation of the pump, thus the accuracy of the failure diagnosis for the thermostat valve can be improved.

Preferably, in the step of setting a leakage flow rate, a leakage flow rate for a large pump flow rate is set to be a larger value as compared to a leakage flow rate for a small pump flow rate.

According to such a configuration, even when the difference between the coolant water temperature in the coolant water passage and the coolant water temperature in the radiator circulation passage becomes smaller due to an increase in the pump flow rate and in turn an increase in the leakage flow rate to the radiator circulation passage, the coolant water temperature in the radiator circulation passage is estimated taking into consideration the increase in the leakage flow rate to the radiator circulation passage due to the increase in the pump flow rate, so that the accuracy of the failure diagnosis for the thermostat valve can be improved.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
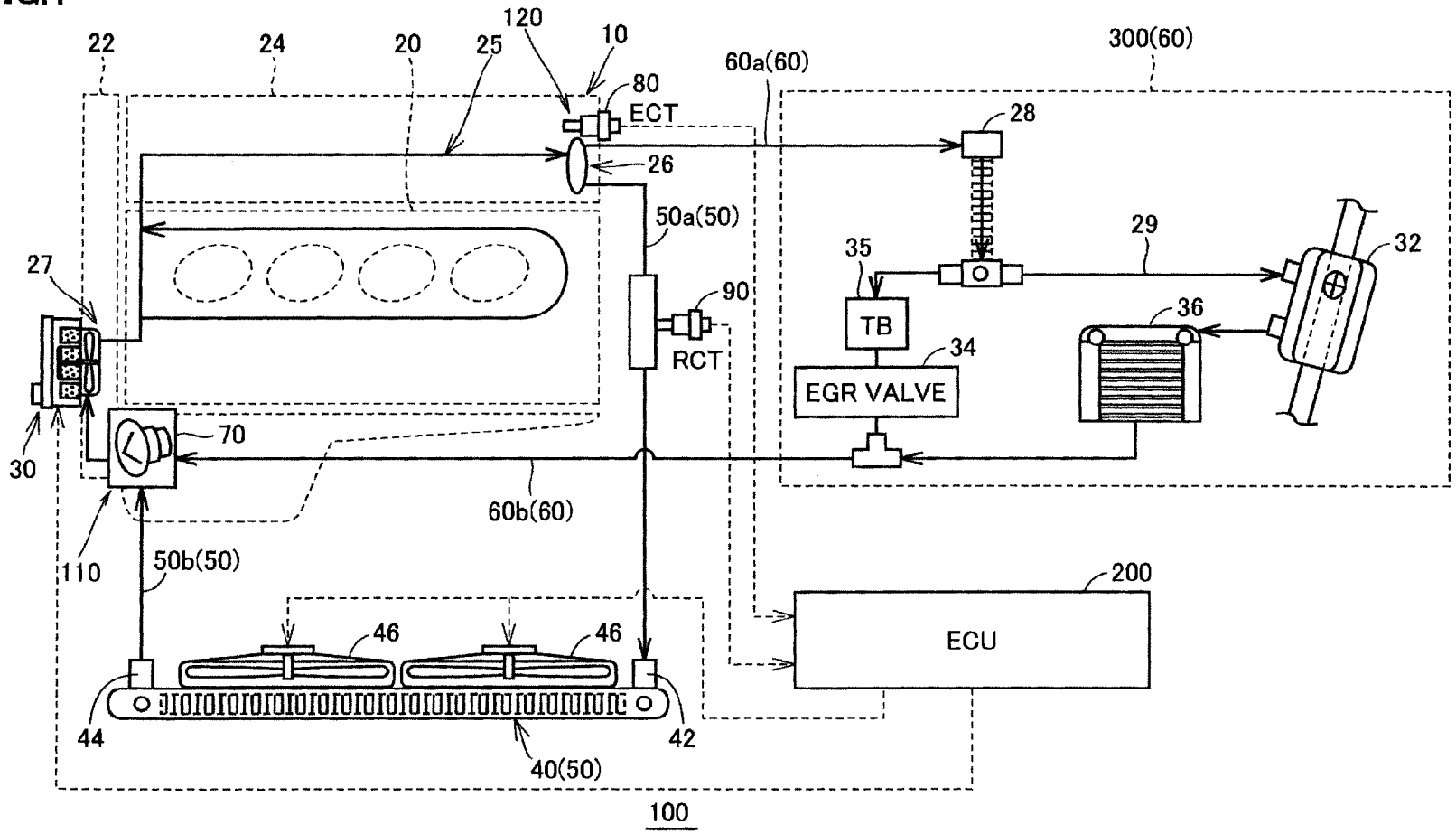
FIG. 1 represents a schematic plan view for explanation of a configuration of a vehicle including a cooling device for an internal combustion engine according to an embodiment of the present invention.

In the following, the embodiment of the present invention will be described in detail with reference to the drawings. It should be noted that the same or corresponding parts in the drawings have the same reference numerals allotted and description thereof will not be repeated.

FIG. 1 represents a schematic plan view for explanation of a configuration of a vehicle including a cooling device for an internal combustion engine according to an embodiment of the present invention. Referring to FIG. 1, a vehicle 100 includes an engine 20 and an engine cooling device 10 for cooling engine 20.

Engine cooling device 10 includes an electric water pump (hereinafter, referred to as "electric pump") 30, a radiator 40, a radiator circulation passage 50, a bypass passage 60, a thermostat valve 70, an engine-side coolant water temperature sensor 80, a radiator-side coolant water temperature sensor 90, and a control device (hereinafter, also referred to as "ECU (Electronic Control Unit)") 200.

Engine 20 has a water jacket 24 for cooling engine 20 by means of coolant water. Water jacket 24 is formed around cylinders of engine 20 and constitutes a coolant water passage 25 allowing coolant water to pass therethrough. Coolant water passage 25 is provided between an inlet 27 and an outlet 26, and allows coolant water from inlet 27 to be sent out from outlet 26. The coolant water flowing into coolant water passage 25 performs a heat exchange with engine 20 to cool engine 20. Accordingly, engine 20 is maintained at a temperature which is suitable for combustion.

Electric pump 30 is a pump driven by an electric motor to circulate coolant water of engine 20. Electric pump 30 is mounted to an attachment-side surface portion 22 of an engine main body. Electric pump 30 allows coolant water to be sent out from inlet 27 into coolant water passage 25.

Driving and stopping of electric pump 30 is controlled by a control signal received from ECU 200. Further, a discharge amount of coolant water discharged from electric pump 30 is controlled by a control signal received from ECU 200.

Outlet 26 constitutes a branch portion 120. Branch portion 120 is connected to radiator circulation passage 50 and bypass passage 60. Branch portion 120 separates coolant water from coolant water passage 25 into coolant water directed to radiator circulation passage 50 and coolant water directed to bypass passage 60.

Radiator circulation passage 50 is a passage for circulating coolant water between engine 20, electric pump 30, and radiator 40. Radiator circulation passage 50 includes pipes 50*a*, 50*b* and radiator 40. Pipe 50*a* is provided between branch portion 120 and an inlet 42 of radiator 40. Pipe 50*b* is provided between an outlet 44 of radiator 40 and thermostat valve 70. Coolant water warmed up in engine 20 passes through radiator 40 and is cooled.

Radiator 40 performs a heat exchange between coolant water flowing in radiator 40 and outside air to thereby radiate heat of the coolant water. Radiator 40 is provided with cooling fans 46. Cooling fan 46 accelerates a heat exchange through ventilation to improve a heat-radiation efficiency of the coolant water in radiator 40. Coolant water cooled in radiator 40 is sent out from outlet 44.

Bypass passage 60 is a passage for circulating coolant water while circumventing radiator 40. Bypass passage 60 includes pipes 60*a*, 60*b* and thermal component 300. Pipe 60*a* is provided between branch portion 120 and thermal component 300. Pipe 60*b* is provided between thermal component 300 and thermostat valve 70.

Thermal component 300 includes an EGR (Exhaust Gas Recirculation) cooler 28, a pipe 29, an exhaust heat recovery unit 32, a heater 36, a throttle body 35, and an EGR valve 34.

EGR cooler 28 cools EGR gas by means of coolant water. Exhaust heat recovery unit 32 warms up the coolant water by heat of exhaust gas to thereby improve an engine mobility during a low temperature. Throttle body 35 is warmed up by coolant water to prevent occurrence of adhesion and the like. EGR valve 34 is cooled by the coolant water.

Thermostat valve 70 is arranged at a merging portion 110 which merges coolant water having passed through radiator circulation passage 50 and coolant water having passed through bypass passage 60. Merging portion 110 is connected to radiator 40 through pipe 50*b* and connected also to pipe 60*b*. The coolant water from merging portion 110 returns to a suction port of electric pump 30.

Thermostat valve 70 is opened and closed in accordance with a temperature of coolant water, and adjusts distribution of the amount of coolant water passing through both passages of radiator circulation passage 50 and bypass passage 60. Thermostat valve 70 adjusts a mixture ratio of coolant water in the cooling passage, so that the temperature of the coolant water passing through the engine coolant water passage is maintained at an appropriate temperature for engine 20. Operation of thermostat valve 70 will be described in detail later.

Engine-side coolant water temperature sensor 80 is provided at branch portion 120. Engine-side coolant water temperature sensor 80 detects a temperature of coolant water sent out from outlet 26 and outputs a detected water temperature ECT to ECU 200. It should be noted that engine-side coolant water temperature sensor 80 is all necessary to be provided on a passage through which coolant water always circulates, and it may be provided for example on coolant water passage 25.

Radiator-side coolant water temperature sensor 90 is provided on pipe 50*a*. Radiator-side coolant water temperature sensor 90 detects a temperature of coolant water flowing into radiator circulation passage 50 and outputs a detected water temperature RCT to ECU 200. It should be noted that radiator-side coolant water temperature sensor 90 is all necessary to be provided on radiator circulation passage 50, and it may be provided for example on pipe 50*b*.

ECU 200 performs a failure diagnosis for thermostat valve 70 based on detected water temperature ECT received from engine-side coolant water temperature sensor 80 and detected water temperature RCT received from radiator-side coolant water temperature sensor 90.

When a valve body of thermostat valve 70 is in a closed state, a flow of coolant water on the side of radiator circulation passage 50 is interrupted by the valve body, and cannot circulate in coolant water passage 25. On the other hand, coolant water on the side of bypass passage 60 passes through the valve body and circulates in coolant water passage 25. Therefore, only the coolant water flowing back from the side of bypass passage 60 passes through coolant water passage 25.

Then, after engine 20 is started and warmed up, coolant water in coolant water passage 25 is warmed up. Therefore, the returning coolant water which having passed through thermostat valve 70 from pipe 60*b* of bypass passage 60 and warmed up in coolant water passage 25 flows back in the direction of bypass passage 60, so that warm-up operation of engine 20 is performed.

Thermostat valve 70 moves the valve body in accordance with a rise in temperature of passing coolant water. The coolant water, which is circulated from the side of radiator circulation passage 50 when thermostat valve 70 is opened in accordance with movement of the valve body, passes through thermostat valve 70 and is mixed with returning coolant water flowing back from bypass passage 60.

When the coolant water having a relatively low temperature, which flows in from the side of radiator circulation passage 50 and is cooled by radiator 40, is mixed with returning coolant water flowing back from bypass passage 60, the mixture ratio is controlled by opened and closed states of the valve body of thermostat valve 70, and is adjusted so as to obtain an appropriate water temperature for the temperature of coolant water supplied to coolant water passage 25 in water jacket 24 of engine 20.

On the other hand, when thermostat valve 70 is failed, a close failure, in which the valve body does not open even when the temperature in the passing coolant water rises, and an open failure, in which the valve body does not close even when the temperature of the passing coolant water is lowered, may occur. In the state where such a failure occurs, coolant water of an appropriate water temperature cannot be supplied to coolant water passage 25 of engine 20, so that an operation efficiency of engine 20 is lowered. Therefore, it is preferable to continuously perform a failure diagnosis on whether or not thermostat valve 70 functions in a normal manner to find out the failure in an early stage.

Generally, at the water temperature of not allowing thermostat valve 70 to open in nature, when the temperature difference between detected water temperature ECT and detected water temperature RCT is small, it can be determined that thermostat valve 70 is failed, assuming that thermostat valve 70 is opened.

However, even at the temperature of not allowing thermostat valve 70 to open in nature, when the water pressure of circulation passage 50 is raised by driving of electric pump 30, the leakage flow rate occurs in thermostat valve 70. In this case, even through thermostat valve 70 is closed, the coolant water in coolant water passage 25 is mixed with coolant water in radiator circulation passage 50, so that the temperature of both coolant water comes close, thereby lowering the accuracy of the failure diagnosis.

In the present embodiment, the failure diagnosis for thermostat valve 70 is performed based on a temperature difference between the estimated temperature of the coolant water of radiator circulation passage 50, which is calculated based on the detected water temperature of engine-side coolant water temperature sensor 80 and the leakage flow rate flowing in radiator circulation passage 50 when thermostat valve 70 is in the closed state, and the detected water temperature of radiator-side coolant water temperature sensor 90. In the following, the failure detection for the thermostat valve will be described in detail.

Figure 2:
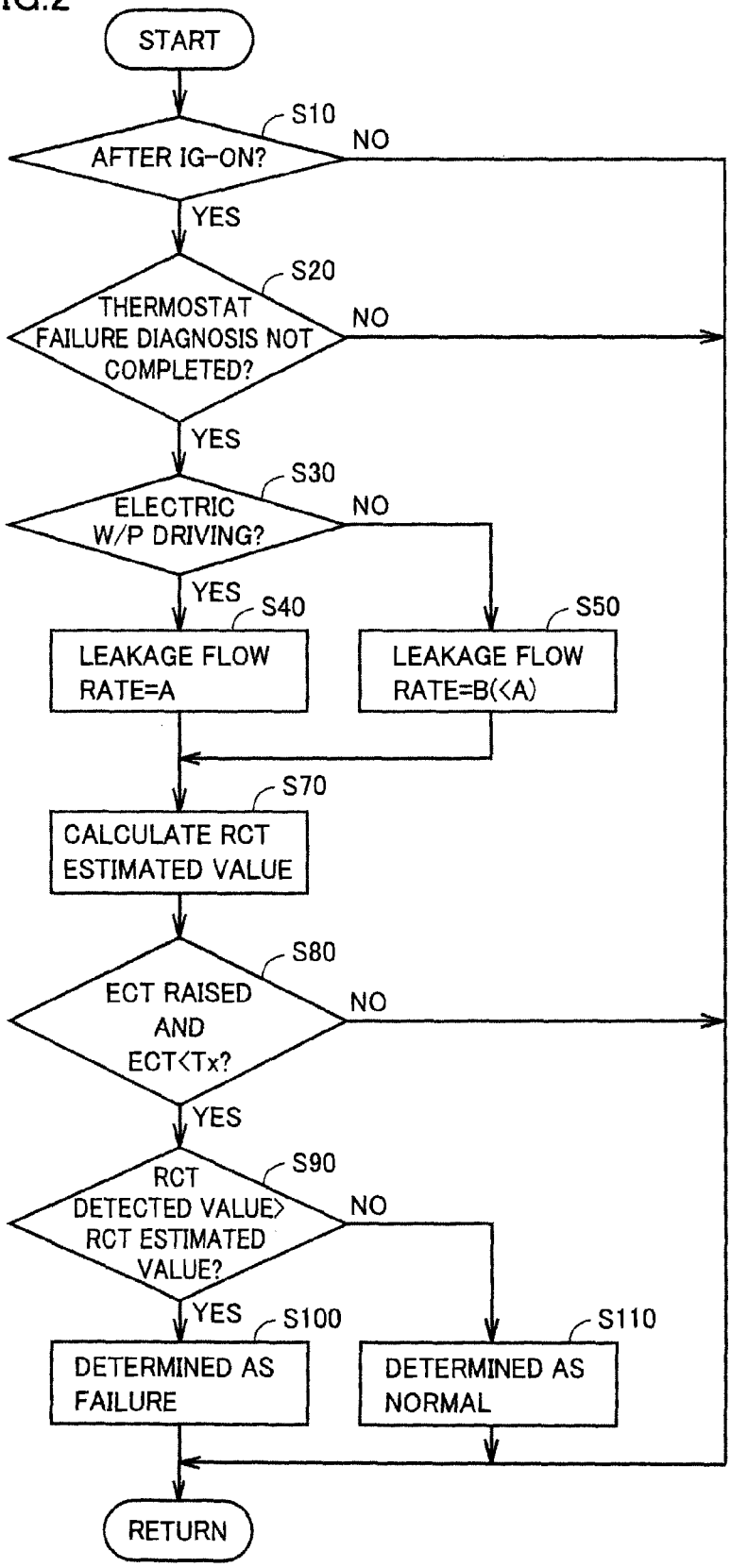
FIG. 2 represents a flowchart of a process executed by the control device shown in FIG. 1 to perform a failure detection for a thermostat valve.

FIG. 2 is a flowchart of a process executed by ECU 200 shown in FIG. 1 to perform the failure detection for thermostat valve 70. The flowchart shown in FIG. 2 is achieved by executing a program stored in advance in ECU 200 at predetermined cycles. Alternatively, processes for some steps can be achieved by constructing a dedicated hardware (electronic circuit).

Referring to FIG. 2 together with FIG. 1, ECU 200 determines in step (hereinafter, the step will be abbreviated to "S") 10 whether or not it is after IG-on operation. It should be noted that the IG-on operation is the operation for allowing vehicle 100 to be in a travelable state. When it is determined that it is after the IG-operation (YES in S10), ECU 200 determines whether or not a thermostat failure diagnosis is not completed (S20).

When it is determined that the thermostat failure diagnosis is not completed (YES in S20), ECU 200 determines whether or not electric pump 30 is driving (S30). When it is determined that electric pump 30 is driving (YES in S30), ECU 200 sets the leakage flow rate to be at a flow rate A (S40). On the other hand, when it is determined that electric pump 30 is not driving (NO in S30), ECU 200 sets the leakage flow rate to be a flow rate B (S50). Herein, flow rate A set during driving of electric pump 30 is a value larger than flow rate B set during stopping of electric pump 30, and flow rate B is 0 or a value close to 0.

Even when thermostat valve 70 is in the closed state, if electric pump 30 is driven, the water pressure occurs in radiator circulation passage 50 along with driving of the pump, and a leakage of thermostat valve 70 (a flow in radiator circulation passage 50) occurs. On the other hand, during stopping of electric pump 30, the water pressure along with driving of the pump does not occur. Therefore, the leakage of thermostat valve 70 basically does not occur, or an extremely small amount of leakage may occur. Therefore, in engine cooling device 10 according to the present embodiment, while taking into the account the leakage of thermostat valve 70 which occurs along with driving of electric pump 30, setting of the leakage flow rate during driving of electric pump 30 (flow rate A) is rendered to have a larger value as compared to the setting of the leakage flow rate during stopping of electric pump 30 (flow rate B). Accordingly, the accuracy of the RCT estimated value, which will be described later, improves, and the accuracy of the failure diagnosis for thermostat valve 70 improves.

Moreover, in engine cooling device 10 according to the present embodiment, flow rate A is set to be a larger value as the flow rate of electric pump 30 is larger. This takes into consideration that the water pressure in radiator circulation passage 50 rises as the flow rate of electric pump 30 is larger, and also the leakage of thermostat valve 70 (a flow in radiator circulation passage 50) is larger.

Figure 3:
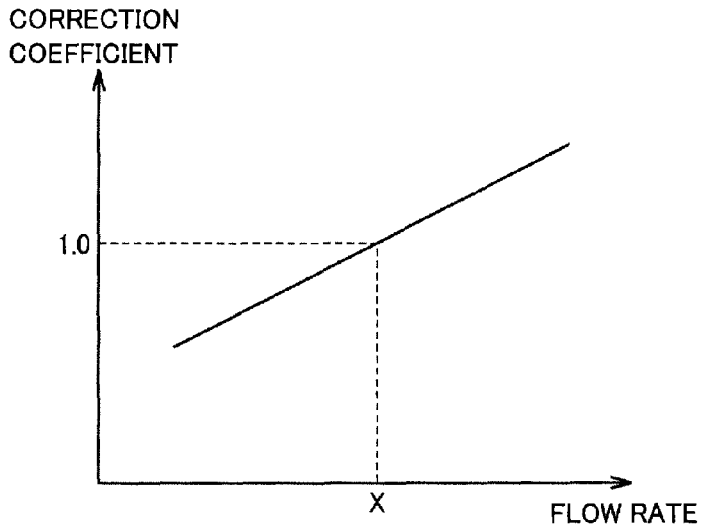
FIG. 3 represents a relationship between a pump flow rate and a correction coefficient.

FIG. 3 represents a relationship between the pump flow rate and the correction coefficient. Referring to FIG. 3, ECU 200 corrects the leakage flow rate (flow rate A) by setting the correction coefficient to be 1, provided that the pump flow rate is a reference flow rate X, and multiplies reference flow rate X by the correction coefficient. As illustrated in the drawing, the correction coefficient is set to be larger as the pump flow rate is larger. It should be noted that although FIG. 3 illustrates the case where the relationship between the pump flow rate and the correction coefficient is linear, the relationship between the pump flow rate and the correction efficient is not limited to the linear relationship. With such a correction, setting of the leakage flow rate (flow rate A) during driving of electric pump 30 is larger as the pump flow rate is larger. Then, such a setting of flow rate A improves the accuracy of the RCT estimated value (described later), and the failure diagnosis accuracy for thermostat valve 70 can also be improved.

As to the correction of the leakage flow rate (flow rate A) with use of the correction coefficient, the correction can be made based on the physical quantity related to the flow rate of electric pump 30 in place of the flow rate of electric pump 30. For example, the leakage flow rate (flow rate A) can be corrected based on a rotation speed of electric pump 30, a rotation speed of engine 20, an intake amount of engine 20, a load of the air-conditioning heater, or the like.

Moreover, in place of electric pump 30, a mechanical water pump driven by engine 20 may be used. Also in this case, in place of the flow rate of the mechanical water pump, the leakage flow rate (flow rate A) may be corrected based on the physical quantity related to the flow rate of the mechanical water pump. For example, the correction can be made based on the rotation speed of engine 20.

Since electric pump 30 can operate even when engine 20 is stopped, employing electric pump 30 can improve the frequency of the failure diagnosis, so that the diagnosis accuracy is improved consequently. On the other hand, in the case of employing the mechanical water pump, there is no need to provide a separate electric pump. Therefore, the improvement in the accuracy of the failure diagnosis can be achieved at a low cost.

Referring back to FIG. 2, when it is determined in S10 that it is not after the IG-on operation (NO in S10), or when it is not determined in S20 that the thermostat failure diagnosis is not completed (NO in S20), the subsequent processes are not executed, and the process returns to the main routine.

Next in S70, ECU 200 calculates the RCT estimated value which is an estimated value of the temperature of the coolant water at a position of radiator-side coolant water temperature sensor 90.

Specifically, ECU 200 can calculate the RCT estimated value using the following equation, as one example.

$$\text{RCT estimated value}=(\text{detected water temperature ECT}\times\text{leakage flow rate}+\text{RCT estimated value (previous value)}\times(\text{pipe volume}-\text{leakage flow rate}))/\text{pipe volume} \quad (1)$$

In Equation (1), the RCT estimated value is calculated assuming that coolant water with the detected water temperature ECT and coolant water with the RCT estimated value (previous value) are evenly mixed in accordance with a ratio of the leakage flow rate with respect to the pipe volume. It should be noted that the pipe volume is a volume of the pipe of coolant water flowing from engine-side coolant water temperature sensor 80 to radiator-side coolant water temperature sensor 90. Moreover, the calculation accuracy can be improved by dividing the pipe into any suitable number of regions and applying Equation (1) to each of the divided regions.

Next in S80, ECU 200 determines whether or not detected water temperature ECT rises and detected water temperature ECT is lower than a predetermined value Tx. It should be noted that predetermined value Tx is a valve-opening temperature allowing thermostat valve 70 to open. When it is determined that detected water temperature ECT does not rise, or that detected water temperature ECT is larger than or equal to predetermined value Tx (NO in S80), subsequent processes are skipped, and the process returns to the main routine.

When it is determined that detected water temperature ECT rises, and detected water temperature ECT is lower than predetermined value Tx (YES in S80), it is determined whether or not the RCT detected value (detected water temperature RCT) is higher than the RCT estimated value (S90). When it is determined that the RCT detected value is higher than the RCT estimated value (YES in S90), ECU 200 determines that thermostat valve 70 is in an open failure state (S100). When it is determined that the RCT detected value is less than or equal to the RCT estimated value (NO in S90), ECU 200 determines that thermostat valve 70 is normal (S110).

As described above, in the present embodiment, the failure diagnosis for thermostat valve 70 is performed based on a temperature difference between the estimated temperature (RCT estimated value) of the coolant water of radiator circulation passage 50, which is calculated based on detected temperature ECT of engine-side coolant water temperature sensor 80 and the leakage flow rate flowing through radiator circulation passage 50 during the closed state of thermostat valve 70, and the detected water temperature (RCT detection value) of radiator-side coolant water temperature sensor 90. The leakage flow rate during operation of electric pump 30 is set to be a larger value as compared to the leakage flow rate during stopping of electric pump 30. Further, as to the case where electric pump 30 operates, the leakage flow rate is set to be a larger value as the flow rate of electric pump 30 is larger.

Consequently, even in the case where the leakage flow rate is increased by driving of electric pump 30, and the difference between the detected water temperature of engine-side coolant water temperature sensor 80 and the detected water temperature of radiator-side coolant water temperature sensor 90 becomes small even during the closed state of thermostat valve 70, the failure diagnosis for thermostat valve 70 is performed based on the temperature difference between the RCT estimated value and the RCT detected value, so that lowering of the failure detection accuracy due to the temperature variation caused by the leakage flow rate can be suppressed. Thus, according to the present embodiment, the diagnostic error can be prevented by improving the accuracy in the failure detection for thermostat valve 70.

Moreover, in the present embodiment, ECU 200 may determine that thermostat valve 70 is failed when a ratio of time with the RCT detected value higher than the RCT estimated value is higher than a predetermined value. It should be noted that the predetermined value is a value for determining the failure of thermostat valve 70, and is set to be a value capable of preventing a determination error due to disturbance. In this case, the influence by a temporary disturbance is reduced, so that the failure detection for thermostat valve 70 can be performed in a more stable manner.

Moreover, in the present embodiment, ECU 200 may perform the failure diagnosis for thermostat valve 70 by correcting the leakage flow rate based on the physical quantity related to the flow rate of electric pump 30. In this case, when the coolant water is circulated by electric pump 30, the failure detection for thermostat valve 70 can be performed taking into consideration the leakage flow more accurately. Thus, the accuracy of the failure detection for thermostat valve 70 can be further improved.

Moreover, in the present embodiment, the physical quantity may include at least one of the flow rate of electric pump 30, the rotation speed of electric pump 30, the rotation speed of engine 20, the intake amount of engine 20, and the state of the air-conditioning heater. In this case, the flow rate can be corrected more accurately taking into consideration the condition for the case of driving electric pump 30.

Moreover, in the present embodiment, in place of electric pump 30, a mechanical water pump driven by engine 20 may be provided. In this case, ECU 200 performs the failure diagnosis for thermostat valve 70 by correcting the leakage flow rate based on the rotation speed of engine 20. Accordingly, in the case where the coolant water is circulated by the mechanical water pump, the failure detection can be performed taking into consideration the leakage flow rate more accurately. Thus, the accuracy of the failure detection for thermostat valve 70 can be further improved.

Modified Example

Figure 4:
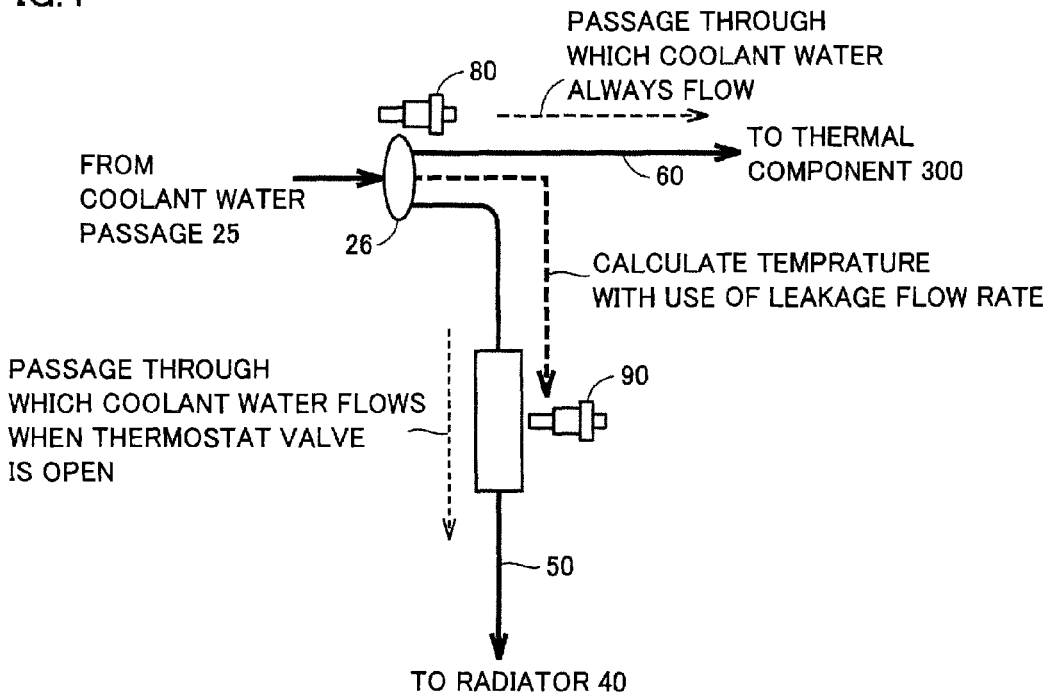
FIG. 4 represents an example of a configuration of the bypass passage shown in FIG. 1.
Figure 5:
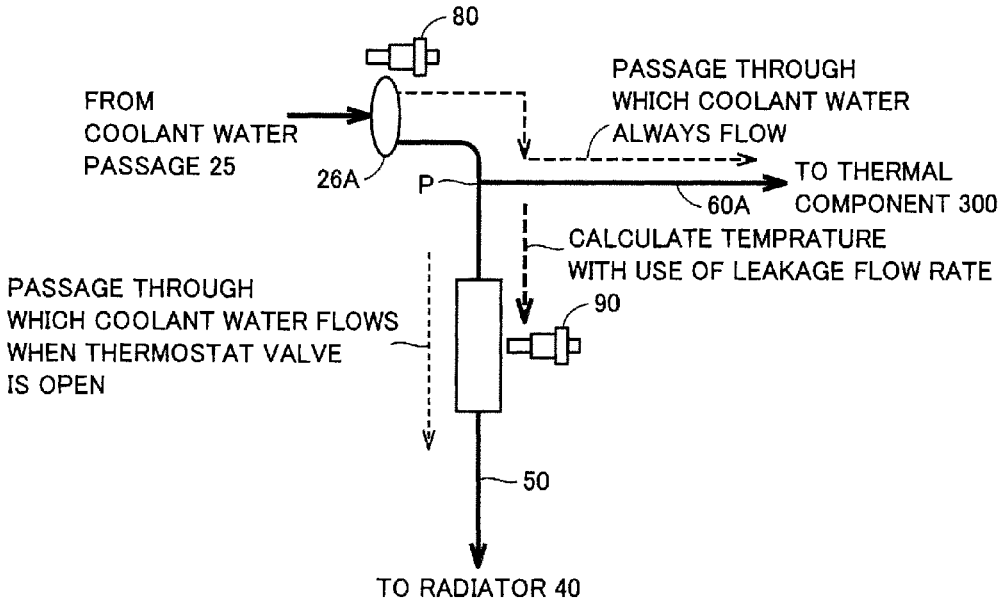
FIG. 5 represents an example of a configuration of a bypass passage according to a modified example of an embodiment of the present invention.

FIG. 4 represents an example of a configuration of the bypass passage shown in FIG. 1. FIG. 5 represents an example of a configuration of the bypass passage according to a modified example of the embodiment of the present invention.

Referring to FIGS. 4 and 5, in the present embodiment, the case was described in which radiator circulation passage 50 and bypass passage 60 are branched at outlet 26. In the modified example of the embodiment, the case will be described in which bypass passage 60A is branched out from radiator circulation passage 50 at a branch point P between outlet 26A and radiator-side coolant water temperature sensor 90. It should be noted that other configuration of outlet 26A and bypass passage 60A according to the modified example of the embodiment is the same as the embodiment.

In the modified example of the embodiment, the calculation method for the RCT estimated value is different from that of the embodiment. Specifically, the temperature variation from outlet 26A to point P is calculated by taking into consideration the time delay in detected water temperature ECT. The temperature variation from branch point P to radiator-side coolant water temperature sensor 90 is calculated using the leakage flow rate.

Accordingly, the RCT estimated value can be calculated with high accuracy even in the case where bypass passage 60A is branched out from radiator circulation passage 50 at branch point P.

It should be noted that although the engine including the electric water pump was described in the embodiment above, the present invention can also be applied to the engine including the pump of other type. For example, a mechanical water pump driven by the engine can be used in place of the electric water pump.

Moreover, in the description above, engine 20 corresponds to one example of the "internal combustion engine" of the present invention. Moreover, engine-side coolant water temperature sensor 80 corresponds to one example of the "first temperature sensor" according to the present invention, and radiator-side coolant water temperature sensor 90 corresponds to one example of the "second temperature sensor" according to the present invention. Moreover, ECU 200 corresponds to one example of the "diagnosis unit" according to the present invention.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A cooling device for an internal combustion engine, comprising:

a coolant water passage formed in said internal combustion engine;

a radiator configured to cool coolant water;

a radiator circulation passage configured to allow coolant water discharged from said coolant water passage to pass through said radiator and return to said coolant water passage;

a bypass passage configured to allow coolant water discharged from said coolant water passage to return to said coolant water passage without passing through said radiator; and a thermostat valve connected to said radiator circulation passage and said bypass passage, said thermostat valve being switched in accordance with a temperature of coolant water flowing in said thermostat valve to either a closed state of interrupting coolant water from said radiator circulation passage and outputting coolant water from said bypass passage to said coolant water passage or an opened state of outputting coolant water from said radiator circulation passage and coolant water from said bypass passage to said coolant water passage, said cooling device further comprising:

a pump configured to circulate coolant water;

a first temperature sensor configured to detect a temperature of coolant water in said coolant water passage;

a second temperature sensor configured to detect a temperature of coolant water in said radiator circulation passage; and a diagnosis unit configured to estimate a temperature of coolant water in said radiator circulation passage based on a leakage flow rate, which is set as a flow rate flowing through said radiator circulation passage even when said thermostat valve is in the closed state, and an output of said first temperature sensor, and perform a failure diagnoses for said thermostat valve based on a difference between an estimated temperature and a detected temperature of said second temperature sensor, said leakage flow rate during operation of said pump being set to be a larger value as compared to said leakage flow rate during stopping of said pump.

2. The cooling device for an internal combustion engine according to claim 1, wherein said leakage flow rate for a large flow rate of said pump or a large physical quantity related to a flow rate of said pump is set to be a larger value as compared to said leakage flow rate for a small flow rate of said pump or a small physical quantity related to the flow rate of said pump.

3. The cooling device for an internal combustion engine according to claim 2, wherein said pump is an electric water pump driven by an electric motor, wherein said physical quantity includes at least one of a rotation speed of said electric water pump, a rotation speed of said internal combustion engine, an intake amount of said internal combustion engine, and a load of an air-conditioning heater.

4. The cooling device for an internal combustion engine according to claim 2, wherein said pump is a mechanical water pump driven by said internal combustion engine, and said physical quantity is a rotation speed of said internal combustion engine.

5. The cooling device for an internal combustion engine according to claim 1, wherein said diagnosis unit determines that said thermostat valve is failed when a ratio of time with a detected temperature of said second temperature sensor higher than said estimated temperature is higher than a predetermined value.

6. The cooling device for an internal combustion engine according to claim 1, wherein said pump is an electric water pump driven by an electric motor.

7. A failure diagnosis method for a cooling device for an internal combustion engine, said cooling device including:

a coolant water passage formed in said internal combustion engine;

a radiator configured to cool coolant water;

a radiator circulation passage configured to allow coolant water discharged from said coolant water passage to pass through said radiator and return to said coolant water passage;

a bypass passage configured to allow coolant water discharged from said coolant water passage to return to said coolant water passage without passing through said radiator; and a thermostat valve connected to said radiator circulation passage and said bypass passage, said thermostat valve being switched in accordance with a temperature of coolant water flowing in said thermostat valve to either a closed state of interrupting coolant water from said radiator circulation passage and outputting coolant water from said bypass passage to said coolant water passage or to an opened state of outputting coolant water from said radiator circulation passage and coolant water from said bypass passage to said coolant water passage, said cooling device further comprising:

a pump configured to circulate coolant water;

a first temperature sensor configured to detect a temperature of coolant water in said coolant water passage; and a second temperature sensor configured to detect a temperature of coolant water in said radiator circulation passage, said failure diagnosis method comprising the steps of:

setting a leakage flow rate flowing through said radiator circulation passage even when said thermostat valve is in the closed state;

estimating a temperature of coolant water in said radiator circulation passage based on said set leakage flow rate and an output of said first temperature sensor; and performing a failure diagnosis for said thermostat valve based on a difference between the estimated temperature and a detected temperature of said second temperature sensor, in said step of setting, said leakage flow rate during operation of said pump is set to be a larger value as compared to said leakage flow rate during stopping of said pump.

8. The failure diagnosis method for a cooling device for an internal combustion engine according to claim 7, wherein in said step of setting, said leakage flow rate for a large flow rate of said pump or a large physical quantity related to a flow rate of said pump is further set to be a larger value as compared to said leakage flow rate for a small flow rate of said pump or a small physical quantity related to the flow rate of said pump.

* * * * *